United States Patent [19]

Lee

[11] Patent Number: 4,827,953

[45] Date of Patent: May 9, 1989

[54] FLEXIBLE LANCE FOR STEAM GENERATOR SECONDARY SIDE SLUDGE REMOVABLE

[75] Inventor: Robert A. S. Lee, Tewksbury, Mass.

[73] Assignee: Electric Power Research Institute, Inc., Palo Alto, Calif.

[21] Appl. No.: 27,810

[22] Filed: Mar. 18, 1987

[51] Int. Cl.[4] ..... B08B 3/02; F22B 37/52

[52] U.S. Cl. ..... 134/172; 122/392; 165/95

[58] Field of Search ..... 376/260, 310, 248, 249, 376/258, 316; 122/382, 392, 405, 379, 380, 390; 165/11.2, 95, 11.1; 134/104, 198, 166 R, 172

[56] References Cited

U.S. PATENT DOCUMENTS

| | | | |
|---|---|---|---|
| 2,949,282 | 8/1960 | Kirkby | 122/379 |
| 4,112,535 | 9/1978 | Wild et al. | 134/198 |
| 4,407,236 | 10/1983 | Schukei et al. | 122/382 |
| 4,424,769 | 1/1984 | Charamathieu et al. | 122/392 |
| 4,445,465 | 5/1984 | Byrd et al. | 122/382 |
| 4,515,747 | 5/1985 | Creek et al. | 376/249 |
| 4,572,284 | 2/1986 | Katsches et al. | 122/405 |
| 4,638,667 | 1/1987 | Zimmer et al. | 165/11.1 |
| 4,661,309 | 4/1987 | Hayes | 376/248 |
| 4,702,878 | 10/1987 | Klug et al. | 376/260 |

*Primary Examiner*—Charles T. Jordan

*Assistant Examiner*—Daniel Wasil

*Attorney, Agent, or Firm*—Flehr, Hohbach, Test, Albritton & Herbert

[57] ABSTRACT

A system (10) for lancing sludge deposits (12) from within a bundle (14) of vertically extending steam generator tubes (16) of a PWR steam generator secondary side assembly (18) has a flexible lance (28) mounted in a lance guide/housing transporter (30). The transporter (30) is movable along blowdown (20) to position end (32) of the flexible lance opposite one of the inter-tube lanes (26) so that the flexible lance (28) may be inserted along the selected inter-tube lane (26). A rigid lance guide (34) on the transporter (30) has a curved end (36) configured to turn the flexible lance (28) at a chosen angle, such as 90°, so that the flexible lance (28) will be fed into the selected inter-tube lane (26). The transporter has a drive (37) for advancing the flexible lance (28) through end (36) of the lance guide (34) and into the inter-tube lane (26). The flexible lance (28) includes a flexible plastic extrusion (38) with a plurality of hollow, flexible metal conduits (40) within the plastic extrusion (38) to extend lengthwise along the lance (28). The nozzle block (44) has nozzles b 48, 50 and 52 so that all portions of the sludge deposits (12) adjacent to the selected inter-tube lane (26) can be reached by the flexible lance (28).

11 Claims, 6 Drawing Sheets

FLEXIBLE LANCE FOR STEAM GENERATOR SECONDARY SIDE SLUDGE REMOVABLE

BACKGROUND OF THE INVENTION

1. Field of the Invention

This invention relates to a novel structure for positioning an orifice for discharging a cleaning fluid jet inside a structure having a plurality of interconnected passages close to deposits to be removed from difficult to access passages inside the structure. More particularly, it relates to such a structure for reaching into steam generator tube bundles and similar assemblies and sludge breakup and removal in an improved manner.

2. Description of the Prior Art

The accumulation of sludge on the secondary side of pressured water reactor (PWR) steam generators in the nuclear power industry is an acute problem which has historically resulted in costly equipment maintenance, replacement and plant down-time. The sludge is a buildup of magnetite and copper compounds which originate in copper alloy condenser tubing and carbon steel condensate and feedwater piping. Removal of sludge is often difficult due to poor access and physical characteristics of the sludge material.

All presently used sludge lancing equipment depends on precise aiming of high pressure water jets from convenient, accessible locations within the typical steam generator. Such areas include the central blowdown lane and/or the annular area between the outer edge of the tube bundles and the internal diameter of the steam generator vessel. However, bare, high pressure water jets, traveling across distance of up to four feet or more have little chance for being delivered effectively to the location of the sludge, due to jet divergence, attendant loss of centerline velocity and interference caused by impact on tubes before the target sludge is reached. Documented success in removal of sludge using these techniques has been less than satisfactory, due primarily to the fact that a high pressure water stream quickly loses its energy as it leasves its high pressure nozzle orifice. As the jet's pressure dissipates in free space, its coherence, or tight focus, also degrades, severely reducing its material-erosion capability. A need therefore exists for improvement of sludge lancing techniques in steam generator tube bundles and similar difficult to access structures.

SUMMARY OF THE INVENTION

Accordingly, it is an object of this invention to provide a structure for positioning an orifice for discharging a cleaning fluid jet inside a structure having a plurality of interconnected passages close to deposits to be removed from difficult to access passages inside the structure.

It is another object of the invention to provide such a structure which will allow full system pressure of the cleaning fluid to be directed locally at the material to be removed at negligible standoff distances, for example, within 1 inch or less.

It is a further object of the invention to provide such a structure which will position a discharge orifice at essentially any desired position within dense tube nests of steam generator tube bundles and similar difficult to access structures.

It is a still further object of the invention to provide a system for moving the structure opposite to an opening of a difficult to access passageway.

It is yet another object of the invention to provide such a structure and system which is able to operate at elevated radiation levels.

These and related objects may be achieved through use of the novel flexible lance structure and system herein disclosed. A flexible lance in accordance with this invention for supplying a cleaning fluid under pressure to sludge deposits in an assembly having a difficult to access geometry includes a flexible member. A plurality of hollow, flexible tubes extend lengthwise along the flexible member. There are a plurality of nozzles at an end of the flexible member. The plurality of nozzles is connected to the plurality of flexible tubes. The flexible member is configured to be driven into the difficult to access geometry.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
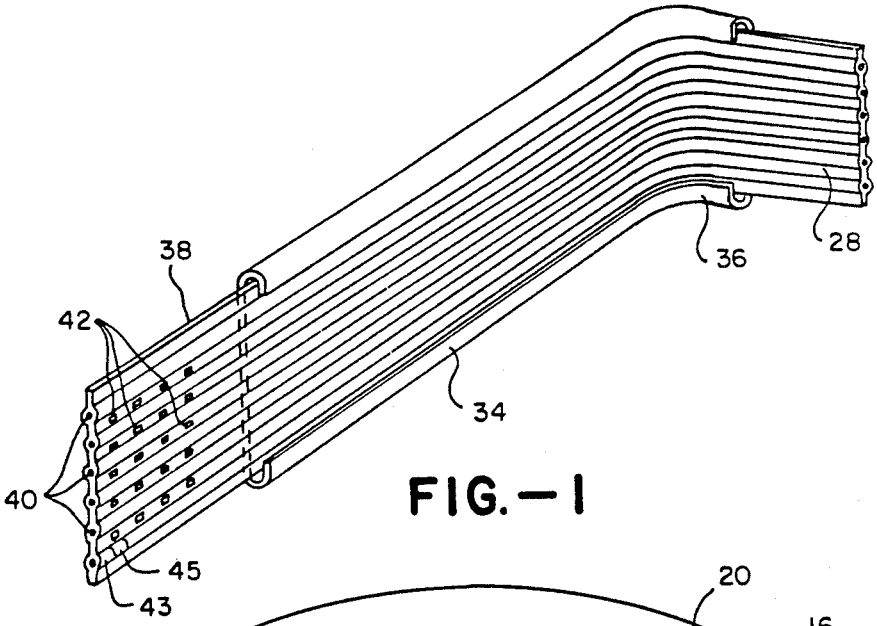
FIG. 1 is a perspective view of a flexible lance in accordance with the invention.
Figure 2:
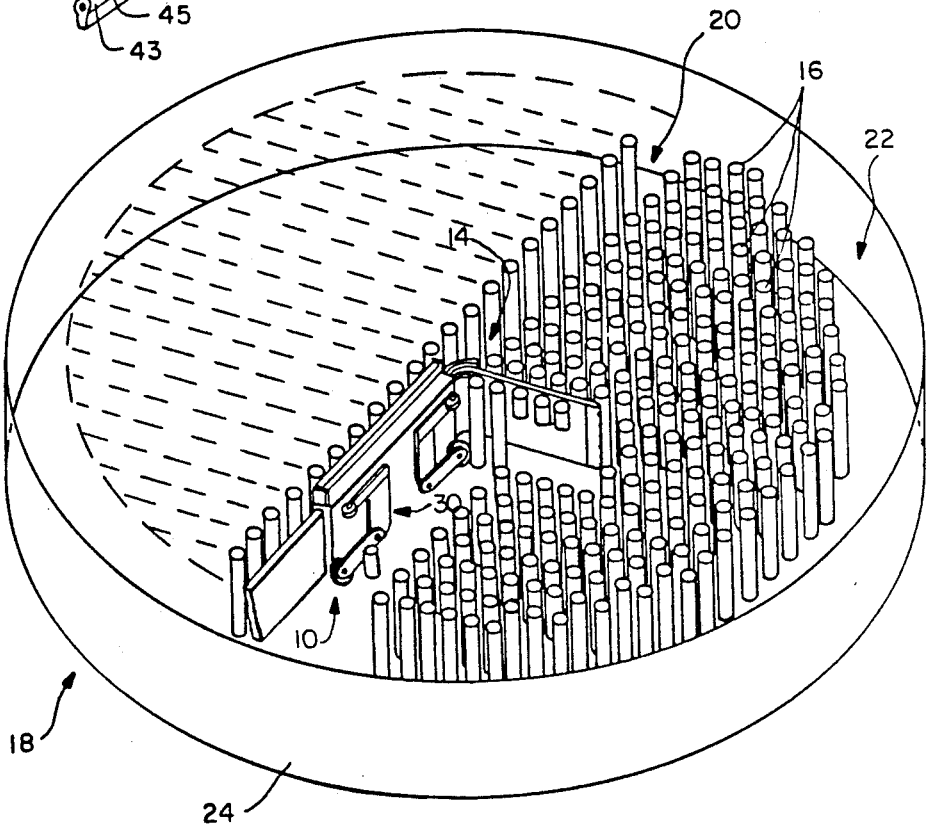
FIG. 2 is a perspective view of the flexible lance of FIG. 1 in a position for use as part of a system in a secondary side of a PWR steam generator.
Figure 2A:
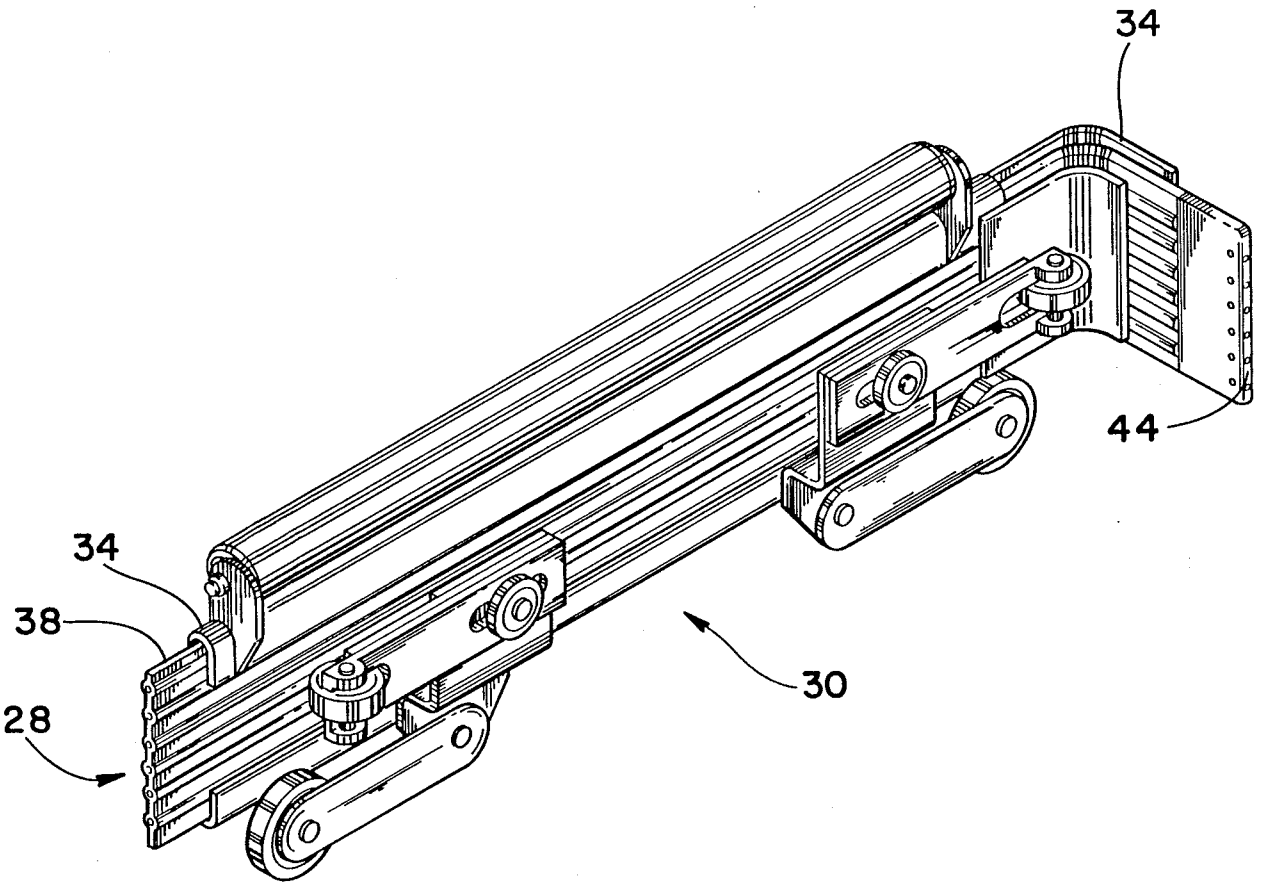
FIG. 2A is an enlarged perspective view of the flexible lance system shown in FIG. 2.
Figure 3:
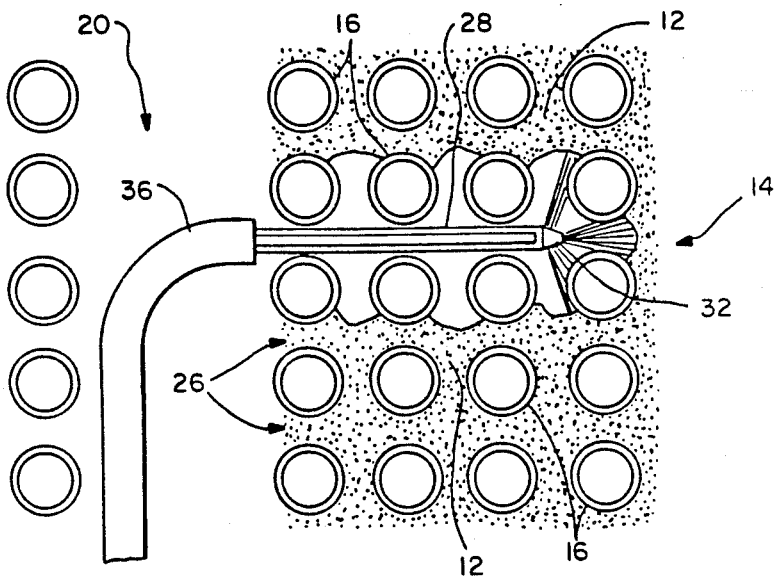
FIG. 3 is a top view of a portion of the flexible lance and system of FIGS. 1 and 2 in use.
Figure 4A:
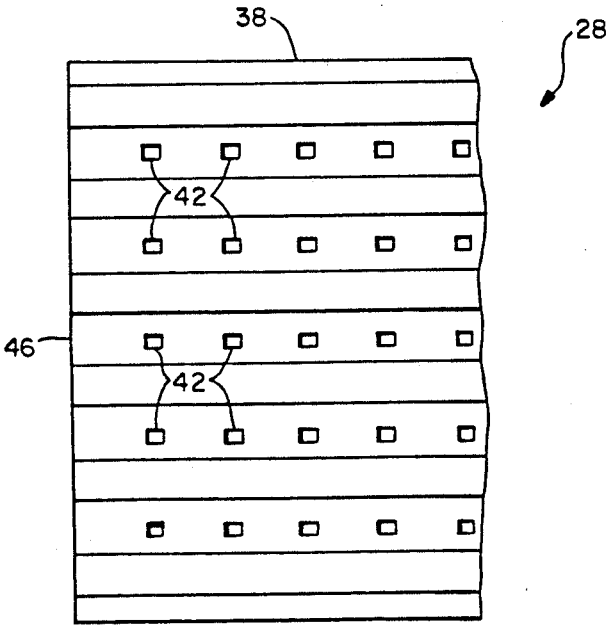
FIGS. 4A and 4B are a partially exploded side view of a portion of the flexible lance of FIG. 1.
Figure 4B:
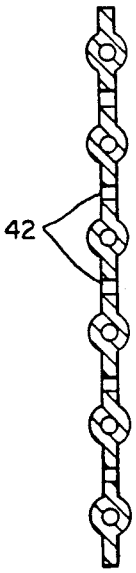
Figure 5A:
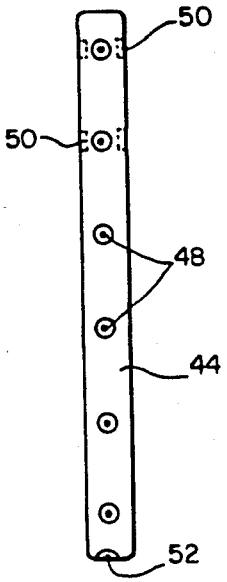
FIGS. 5A and 5B an end view of the the flexible lance of FIGS. 1 and 4.
Figure 5B:
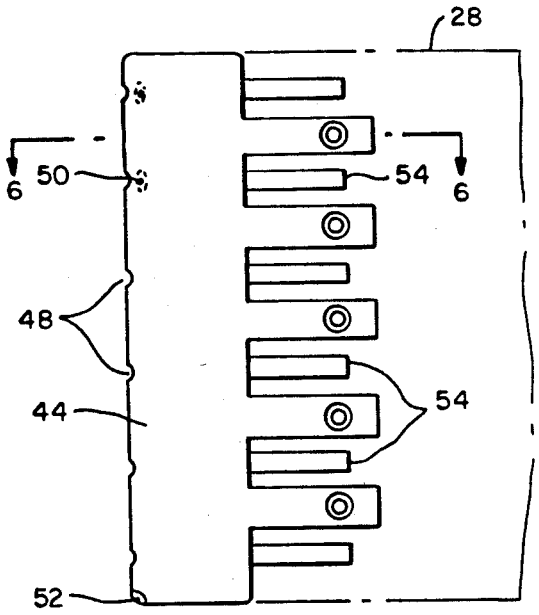
Figure 6:
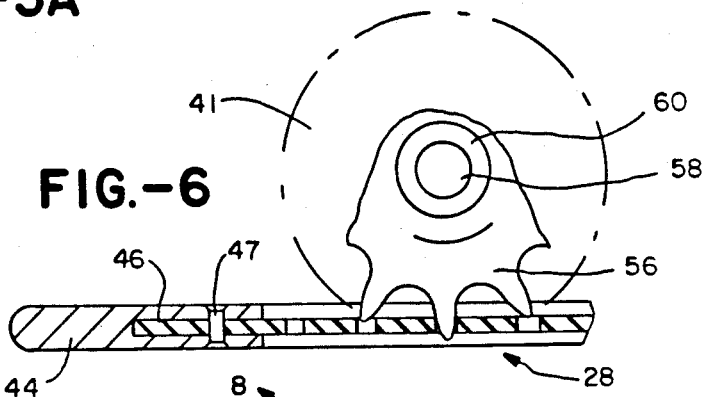
FIGS. 6 is a cross sectional view taken along the line 6—6 in FIG. 5.
Figure 7:
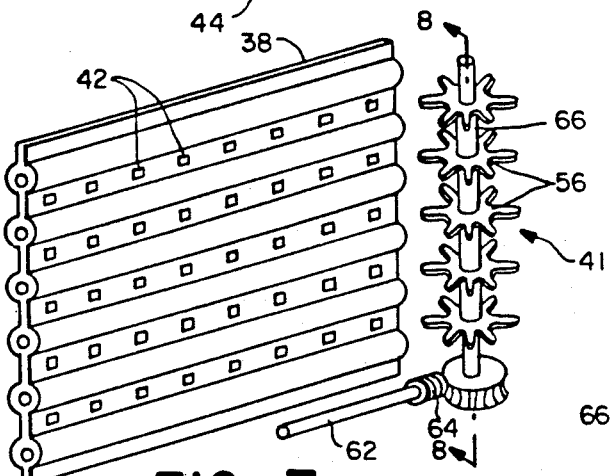
FIG. 7 is a partially exploded schematic representation of a portion of the system of FIGS. 1-3.
Figure 8:
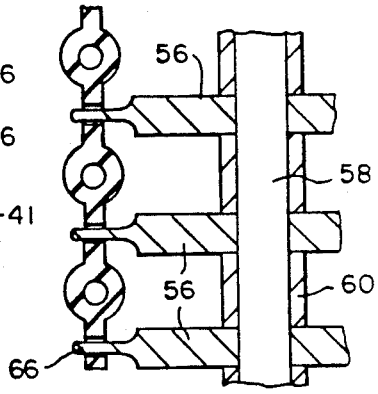
FIG. 8 is a cross section view taken along the line 8—8 in FIG. 7.

Turning now to the drawings, more particularly to FIGS. 1—3, there is shown a system 10 for lancing sludge deposits 12 from within a bundle 14 of vertically extending steam generator tubes 16 of a PWR steam generator secondary side assembly 18. The assembly 18 consists of a pair of the generally semicircular steam generator tubes 16 bundles 14, separated by a blowdown lane 20, encircled by an annular space 22 and enclosed by steam generator walls 24. Each of the tube 16 bundles 14 has a plurality of inter-tube lanes 26 intersecting the blowdown lane 20 and the annular space 22. As explained above, the prior art approach for removing the sludge deposits 12 from the bundles 14 is to direct jets of water from an apparatus positioned in the blowdown lane 20 or the annular space 22 toward the sludge deposits 12 in the bundles 14.

The system 10 of this invention includes a flexible lance 28 mounted in a lance guide/housing transporter 30, which is movable along the blowdown lane 20 to position end 32 of the flexible lance opposite one of the intertube lanes 26 so that the flexible lance 28 may be inserted along the selected inter-tube lane 26. A rigid lance guide 34 on the transporter 30 has a curved end 36 configured to turn the flexible lance 28 at a chosen angle, such as 90°, so that the flexible lance 28 will be fed into the selected inter-tube lane 26. The curved end 36 consists of an inner guide 37 and an outer guide 39 for the flexible lance 28. The transporter has a drive 37 for advancing the flexible lance 28 through end 36 of the lance guide 34 and into the inter-tube lane 26.

The flexible lance 28 includes a flexible plastic extrusion 38 with a plurality of hollow, flexible metal conduits 40, for example, formed from flexible stainless steel or brass, within the plastic extrusion 38 to extend lengthwise along the lance 28. For example, the conduits 40 are desirably implemented with helically wound cartridge brass 43 core covered with an abraded brass sheath 45. This structure will withstand a pressure of up to about 10,000 psi. The extrusion 28 can be fabricated of any suitable flexible plastic, such as a medium density polyethylene. Preferably, the extrusion 28 is extruded from a high strength nylon, delrin or similar material. The conduits 40 are separated by rows of sprocket holes 42 in the extrusion 38.

Further details of the flexible lance 28 and the drive 41 are shown in FIGS. 4–8. The flexible lance 28 has a nozzle block 44 attached to end 46 by soldering or by means of flat rivets 47 mounted through the first sprocket holes 42 on end 46. The nozzle block 44 has forward spraying nozzles 48, side spraying nozzles 50 and down spraying nozzles 52 so that all portions of the sludge deposits 12 adjacent to the selected inter-tube lane 26 can be reached by the flexible lance 28. A plurality of stainless steel thinwall tubes 54 project from the nozzle block 44 to engage the conduits 40 in the extrusion 38. When soldering is used to attach the nozzle block 44 to the extrusion 38, the tubes 54 are soldered to the core 43 of the conduits 40. The drive 41 has a set of sprockets 56 fixedly attached to a shaft 58 and separated by spacers 60. A flexible cable drive 62 is connected to worm gear 64 to drive the shaft 58. Teeth 66 of the sprockets 56 engage the apertures 42 in the extrusion 38 to drive the flexible lance 28 out the end 36 of the lance guide 34 down the inter-tube lanes 26. The drive 41 insures even feeding of the lance 28 from its top to its bottom. Because the drive 41 operates without slippage, counting its revolutions provides a reliable indicator of the position of the lance 28 within an inter-tube lane 26.

Figure 9:
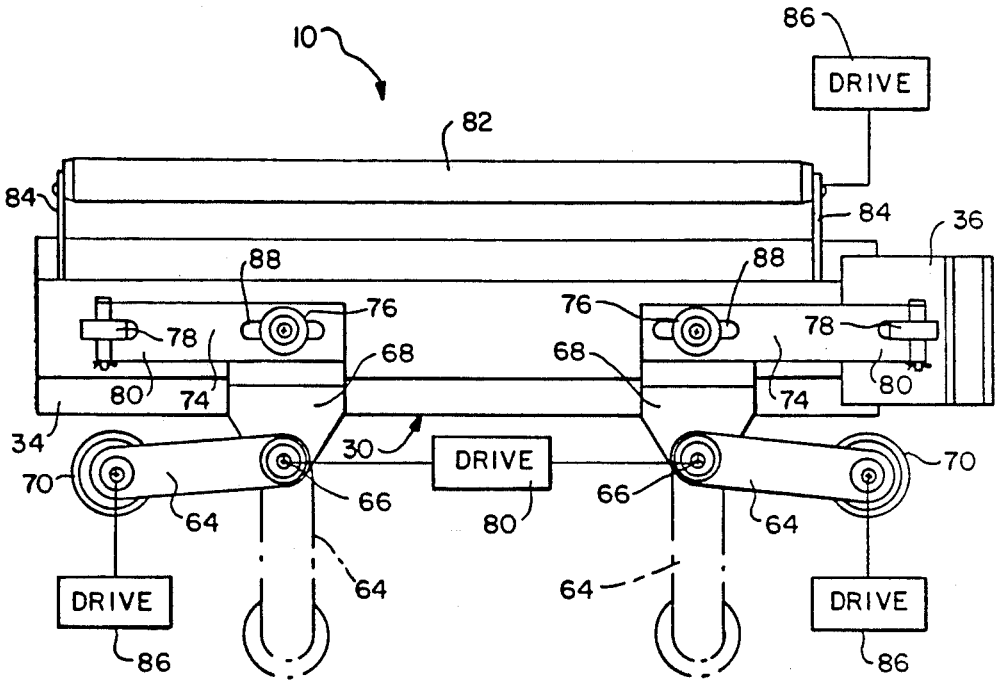
FIG. 9 is a side view of a portion of the system of FIGS. 1-3.
Figure 10:
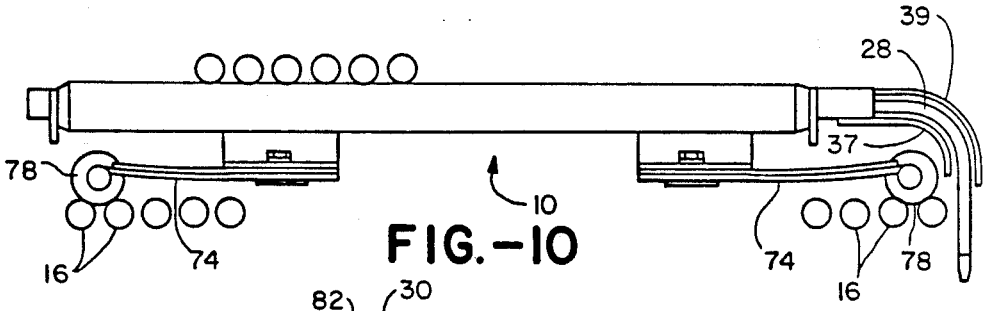
FIG. 10 is a top view of the system portion of FIG. 9.
Figure 11:
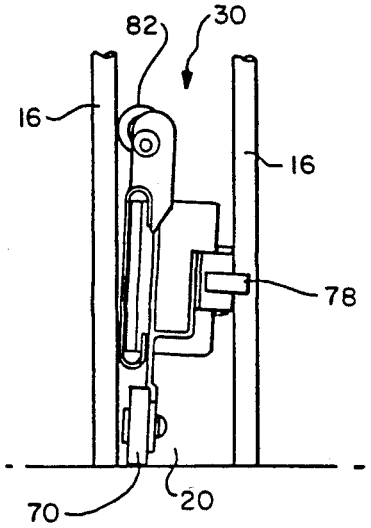
FIG. 11 is an end view of the system portion of FIGS. 9 and 10.

Details of the lance guide/housing transporter 30 are shown in FIGS. 9–11. The lance guide 34 serves as a body of the transporter 30. Wheel arms 64 are pivotally attached at one end 66 to support brackets 68, with drive wheels 70 rotatably mounted at the other end 72 of the wheel arms 64. Horizontal wheel arms 74 are fixedly attached to the bracket 68 by their ends 76, with horizontal wheels 78 rotatably attached to the ends 80 of the horizontal wheel arms 74. Tilt bar 82 is eccentrically mounted for rotation on brackets 84, which are fixedly attached to the lance guide 34. Drives 86, desirably implemented as flexible cable driven worm gear drives, are connected to the wheel arms 64, drive wheels 70 and the tilt bar 82.

Referring to FIG. 2, 3 and 9–11, operation of the system 10 will now be explained. The transporter 30, which is positioned in the blowdown lane 20, is moved with the drive wheels 70 to position end 36 of the lance guide 34 opposite an inter-tube lane 26 down which the flexible lance 34 is to be inserted. The horizontal wheels 78 engage the steam generator tubes 16, as is best shown in FIG. 10, to provide precise positioning of the end 36 opposite the selected inter-tube lance 26. Slots 88 on the horizontal wheel arms 74 allow adjustment of the positions of the horizontal wheels 78 relative to the end 36 to compensate for different geometries of the intertube lanes 26. As is best shown in FIG. 11, the tilt bar 82 engages the steam generator tubes 16 on the other side of the blowdown lane 20 from the steam generator tubes 16 engaged by the horizontal wheels 78, so that the lance guide 34 can be tilted from the horizontal to position the flexible lance 28 with respect to different points of the sludge deposits 12. As indicated in phantom in FIG. 9, the lance guide 34 may also be raised and lowered by pivoting the wheel arms 64. With the flexible lance 28 in position, water or other cleaning fluid under high pressure, for example, 5000 psig, is forced from the nozzles 48, 50 and 52 to jet the sludge deposits into the annular space 22 for removal in a conventional manner.

Figure 12:
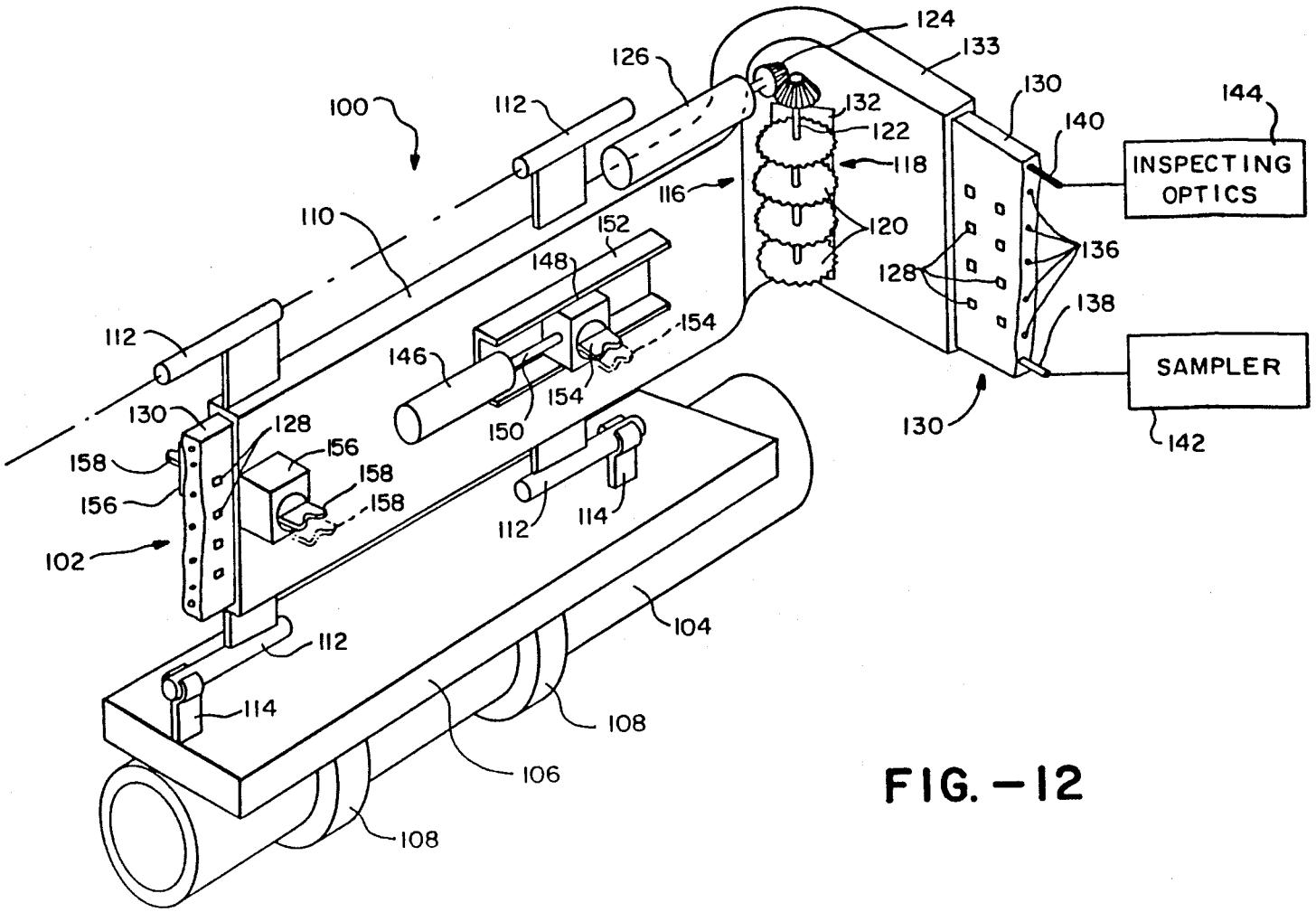
FIG. 12 is a perspective view of another embodiment of a system in accordance with the invention.

FIG. 12 shows another embodiment of a flexible lance system 100, having a transporter 102 designed to ride along blowdown pipe 104. The transporter 102 has a pipe riding cart 106 with roller bearing clamps 108, which pivot laterally to grip the blowdown pipe 104 as shown. Lance guide 110 is attached to the pipe riding cart 106 by means of cylinders 112 engaging trunnions 114. One set of the cylinders 112 engages the trunnions for right side lancing as shown. For left side lancing, the lance guide 110 is inverted so that the other set of cylinders 112 engages the trunnions 114. Drive 116 has a stack 118 of sprockets 120 mounted for rotation with shaft 122, driven by bevel gears 124 and gas turbine 126. Sprockets 120 engage sprocket holes 128 of flexible lance 130 through opening 132 in curved end 133 of the lance guide 110. The flexible lance 130 has a plastic extrusion 134 and a plurality of conduits 136 extending lengthwise along the plastic extrusion 134. Additionally, a flexible cable 138 and a fiber optics cable 140 run along the plastic extrusion 134 in passages above and below the the conduits 136. The conduits 136 have the same construction as the conduits 40 in the FIGS. 1–11 embodiment. The flexible cable 138 is movable within the plastic extrusion 134 to operate a sludge sampler 142, which is connected to the flexible cable 138. Inspecting optics 144 are connected to the fiber optics cable 140 to view the interior of a steam generator or other difficult to access geometry in which the flexible lance system 100 is used.

The transporter 102 is moved along the blowdown pipe 104 by means of a propulsion air cylinder 146, connection to an air cylinder 148 by means of a piston rod 150. The air cylinder 148 is slideably mounted in a track 152. The air cylinder 148 reciprocates a gripper 154, which moves laterally of the lance guide 110, as indicated in phantom, to engage steam generator tubes on the side of the blowdown lane in which the blowdown pipe 104 is located. The air cylinder 146 is actuated with the gripper 154 engaging a steam generator tube to move the cart 106 along the pipe 104. Air cylinders 156 reciprocate grippers 158 to engage the steam generator tubes for inclining the lance guide 110 in a similar manner to lance guide 34 (see also FIG. 11). Except as shown and described, the construction and operation of the FIG. 12 embodiment of the invention is the same as that of the FIGS. 1–11 embodiment.

It should now be readily apparent to those skilled in the art that a novel flexible lance and system for removal of sludge deposits from steam generators and similar assemblies with difficult to access geometries capable of achieving the stated objects of the invention has been provided. The system will position fluid discharge orifices of the flexible lance in close proximity to sludge deposits to be removed in all areas of the steam generators or other complex geometry assemblies. As a result, full system pressure of the cleaning fluid and optimum cleaning jet configuration is available at the sludge deposits for more complete sludge removal. While the structure and system of this invention is particularly useful for the removal of sludge deposits in PWR steam generators in the nuclear power industry because the structure and system is capable of operation with radiation levels of about 40 rads, it should find application in a wide variety of other difficult to access geometries as well.

It should further be apparent to those skilled in the art that various changes in form and detail of the invention as shown and described may be made. For example, the transporter could be designed to move in the annular space of the PWR steam generator, with the flexible lance jetting the sludge deposits and moving them toward the central blowdown lane. It is intended that such changes be included within the spirit and scope of the claims appended hereto.

What is claimed is:

1. A lance system comprising, in combination, a flexible lance for supplying a cleaning fluid under pressure to sludge deposits in an assembly having a difficult to access geometry, which comprises a flexible member, a plurality of hollow, flexible tubes extending lengthwise along said flexible member, and a plurality of nozzles at an end of said flexible member, said plurality of nozzles being connected to said plurality of flexible tubes, said flexible member being configured to be driven into the difficult to access geometry, a rigid guide extending lengthwise of said flexible lance, said flexible lance being movable mounted along said rigid guide, said rigid guide having a curved end positioned to turn said flexible lance in a predetermined angle with respect to an extending direction of said flexible lance as said flexible lance passes from said rigid guide through said curved end, a drive means for driving said flexible lance through the curved end of said rigid guide, a transporter for said combination, in which said rigid guide comprises a body of said transporter, and at least one transporter drive means attached to said body.

2. The combination of claim 1 in which said flexible member comprises a sheetlike plastic extrusion and said hollow, flexible tubes are within said plastic extrusion.

3. The combination of claim 2 in which said plastic extrusion is configured to be driven into the difficult to access geometry by having a plurality of rows of sprocket holes, with a row of said plurality of rows between adjacent ones of said plurality of flexible tubes.

4. The combination of claim 3 in which said plurality of nozzles are provided in a nozzle block, said nozzle block being attached to said plastic extrusion.

5. The combination of claim 3 and a drive means for said flexible lance, comprising a plurality of sprockets fixedly attached to a shaft, said plurality of sprockets each having a plurality of teeth positioned to engage said sprocket holes, and a means for rotating said shaft.

6. The combination of claim 1 in which said at least one transporter drive means comprises a drive wheel rotatably connected to said body and a means coupled to rotate said drive wheel, the combination additionally comprising means for positioning said rigid guide curved end with respect to the difficult to access geometry.

7. The combination of claim 6 in which said means for positioning comprises at least one horizontally rotatable member rotatably connected to said body and positioned to engage a portion of the difficult to access geometry when said transporter is positioned adjacent the difficult to access geometry.

8. The combination of claim 7 additionally comprising an orienting member movable laterally from said body and positioned to engage a structure positioned adjacent said transporter and opposite said orienting member for tilting said body.

9. The combination of claim 8 in which said orienting member comprises a rod rotatable about an eccentrically positioned longitudinal axis extending along said rigid guide and a drive means coupled to rotate said rod.

10. The combination of claim 1 in which said transporter includes a plurality of clamps for mounting said transporter for movement along a pipe.

11. The combination of claim 1 in which said at least one transporter drive means comprises a means for extending a gripper laterally of said body and a means for reciprocating said gripper extending means along said body.

* * * * *

UNITED STATES PATENT AND TRADEMARK OFFICE

CERTIFICATE OF CORRECTION

PATENT NO. : 4,827,953

DATED : May 9, 1989

INVENTOR(S) : Robert A. S. Lee

It is certified that error appears in the above-identified patent and that said Letters Patent is hereby corrected as shown below:

IN THE TITLE: Item [54]

Line 3, "Removable" should be --REMOVAL--

Signed and Sealed this

Seventeenth Day of April, 1990

*Attest:*

*Attesting Officer*

HARRY F. MANBECK, JR.

*Commissioner of Patents and Trademarks*